US007627935B1

(12) United States Patent
Ostrum

(10) Patent No.: US 7,627,935 B1
(45) Date of Patent: Dec. 8, 2009

(54) DOLL URN

(75) Inventor: Deborah R. Ostrum, 5500 Union Valley Rd., Cuba, NY (US) 14727

(73) Assignee: Deborah R. Ostrum, Cuba, NY (US)

( * ) Notice: Subject to any disclaimer, the term of this patent is extended or adjusted under 35 U.S.C. 154(b) by 0 days.

(21) Appl. No.: 12/366,566

(22) Filed: Feb. 5, 2009

(51) Int. Cl.
*A61G 17/00* (2006.01)

(52) U.S. Cl. ..... 27/1; 446/73

(58) Field of Classification Search ..... 27/1, 27/35; D99/5; 220/23.87, 23.89; 446/73, 446/268, 297, 391
See application file for complete search history.

(56) References Cited

U.S. PATENT DOCUMENTS 232,782 A 9/1880 Townsend
D344,840 S 3/1994 May et al.
5,404,343 A 4/1995 Boggio
5,413,516 A 5/1995 Lam
6,023,822 A 2/2000 Luebke
6,447,359 B1 9/2002 Crump
6,665,916 B1 12/2003 Santorello et al.
6,785,938 B1 * 9/2004 Johansen, Jr. ..... 27/1
7,082,653 B1 8/2006 Sueppel
7,308,741 B1 * 12/2007 Rydberg et al. ..... 27/1
7,370,394 B1 * 5/2008 Juneau ..... 27/1
7,467,444 B1 * 12/2008 Johnson, Sr. ..... 27/1
7,526,844 B2 * 5/2009 Pearce ..... 27/1
2002/0100152 A1 * 8/2002 Ortega ..... 27/1
2004/0040129 A1 3/2004 Ogle, II
2005/0120525 A1 6/2005 Heil et al.
2009/0089988 A1 * 4/2009 Johnson, Sr. ..... 27/1

* cited by examiner

*Primary Examiner*—William L. Miller

(57) ABSTRACT

The present invention is directed to a doll urn for storing ashes comprising a body, a head, a top, and a voice recorder for recording and/or playing a message, wherein ashes in a secure container may be inserted into the doll head via an internal compartment aperture.

2 Claims, 3 Drawing Sheets

DOLL URN

FIELD OF THE INVENTION

The present invention is directed to an urn for storing ashes of a human or a pet. More particularly, the present invention is directed to an urn in the form of a doll, wherein the doll urn can play a pre-recorded message.

BACKGROUND OF THE INVENTION

The present invention features a doll urn for storing a human's or a pet's ashes. The doll urn comprises a doll body, a doll head, a doll top, and a voice recorder for recording or playing a message. Disposed in the doll head is an internal compartment, wherein a secure container for holding the ashes may be inserted into the internal compartment via an aperture on the doll head. The doll top comprises a stopper for fitting into the aperture so as to prevent ashes from spilling out of the internal compartment.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
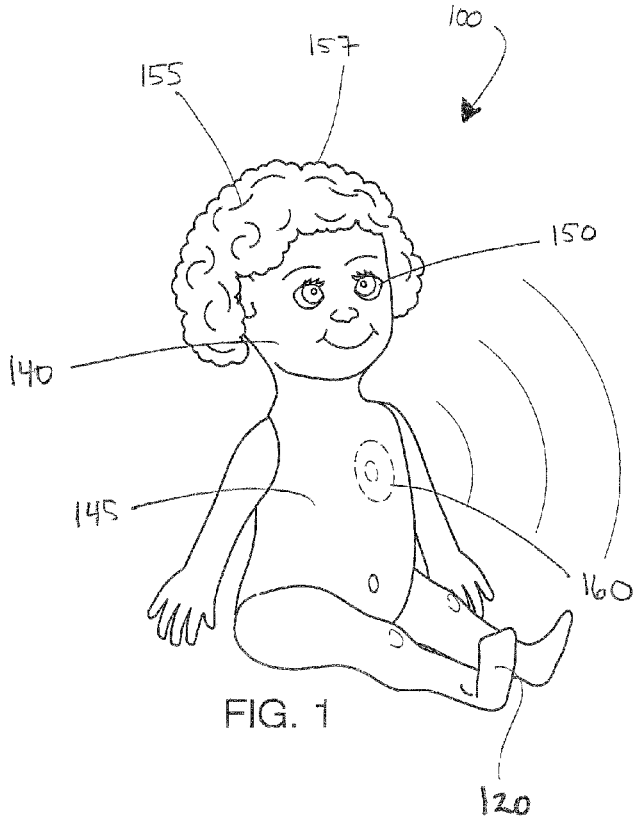
FIG. 1 is a perspective view of a doll urn according to the present invention.

The following is a listing of numbers corresponding to a particular element refer to herein:

100 doll urn
120 doll foot
140 doll head
141 top surface of doll head
145 doll body
150 eye
155 doll top (e.g., doll hair)
156 bottom surface of doll top
157 top surface of doll top
160 voice recorder
200 hollow internal compartment
205 nut
210 aperture of internal compartment
220 stopper

Figure 2:
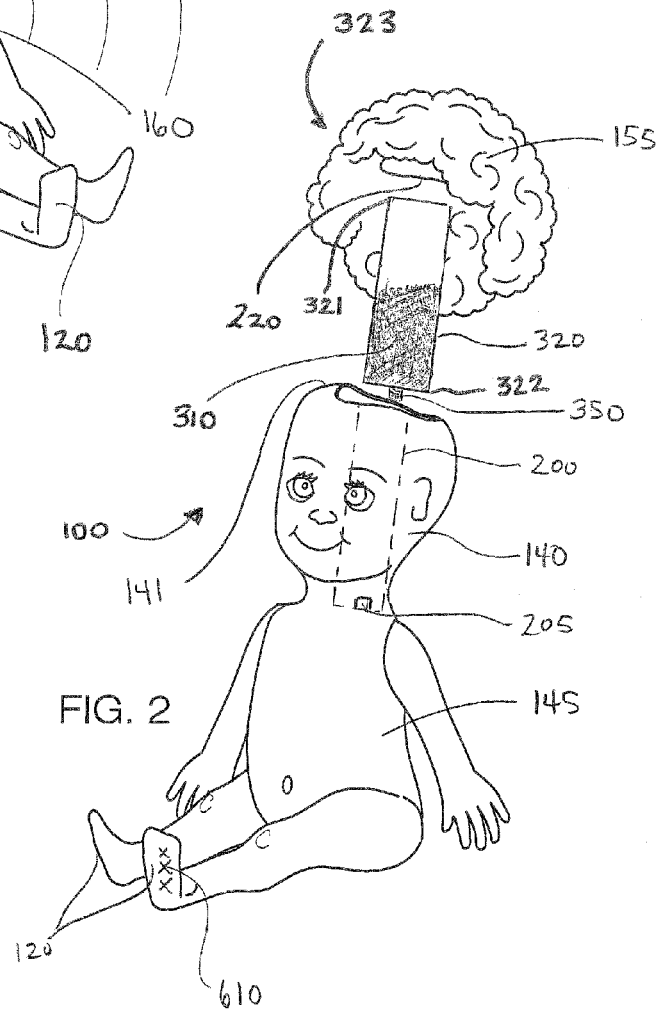
FIG. 2 is a perspective view of the doll urn of FIG. 1, wherein the doll head is removed from the doll body such that ashes may be inserted into the ash compartment inside the doll body.
Figure 3:
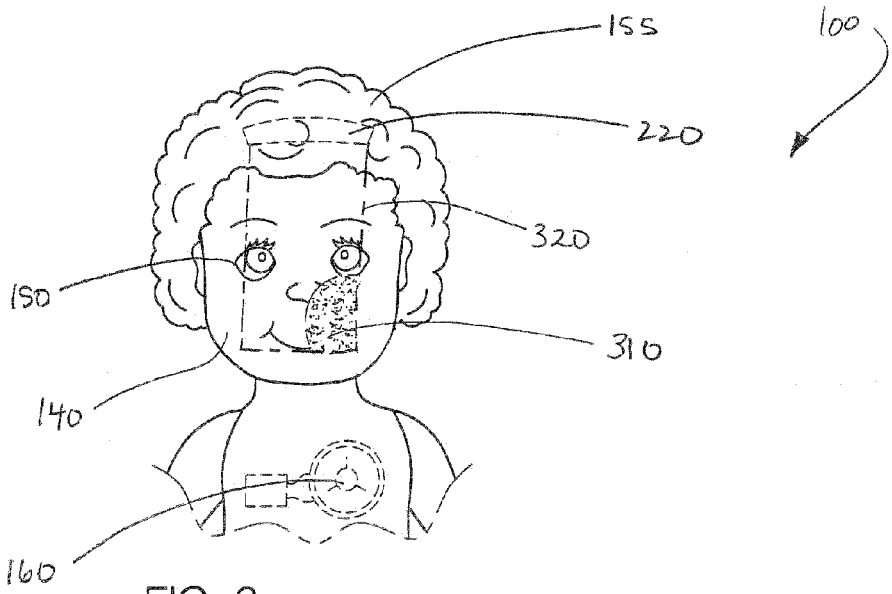
FIG. 3 is a front view and internal view of the doll urn of FIG. 1 illustrating ashes in the secure container inside the internal compartment in the doll head.
Figure 4:
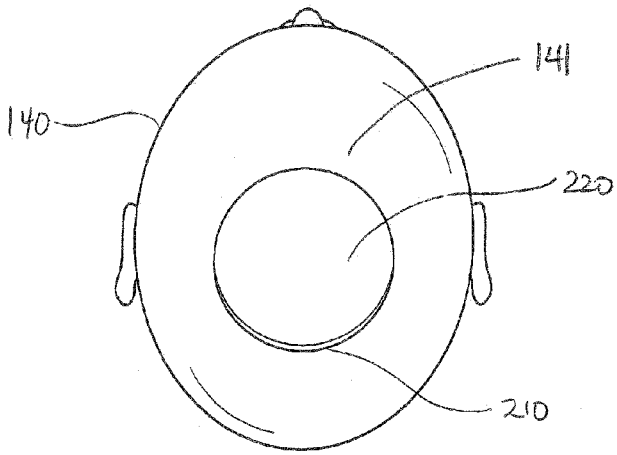
FIG. 4 is a top view of the doll urn of FIG. 1 wherein the doll top (e.g., hair) is removed showing the internal compartment for the container of ashes.
Figure 5:
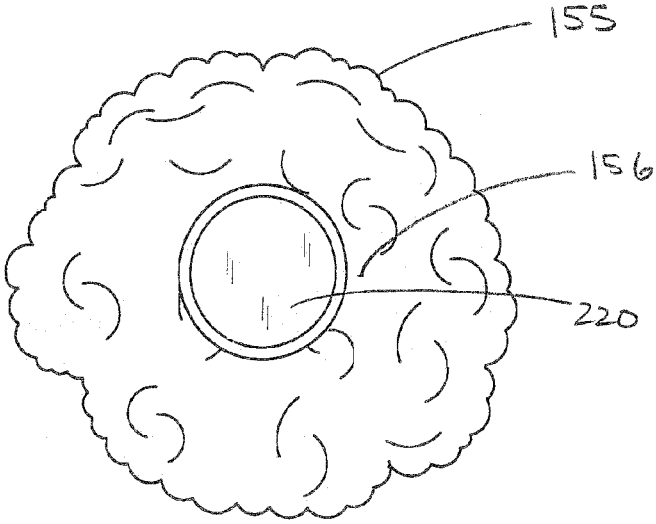
FIG. 5 is bottom view of a doll top (e.g., hair) having a stopper.
Figure 6:
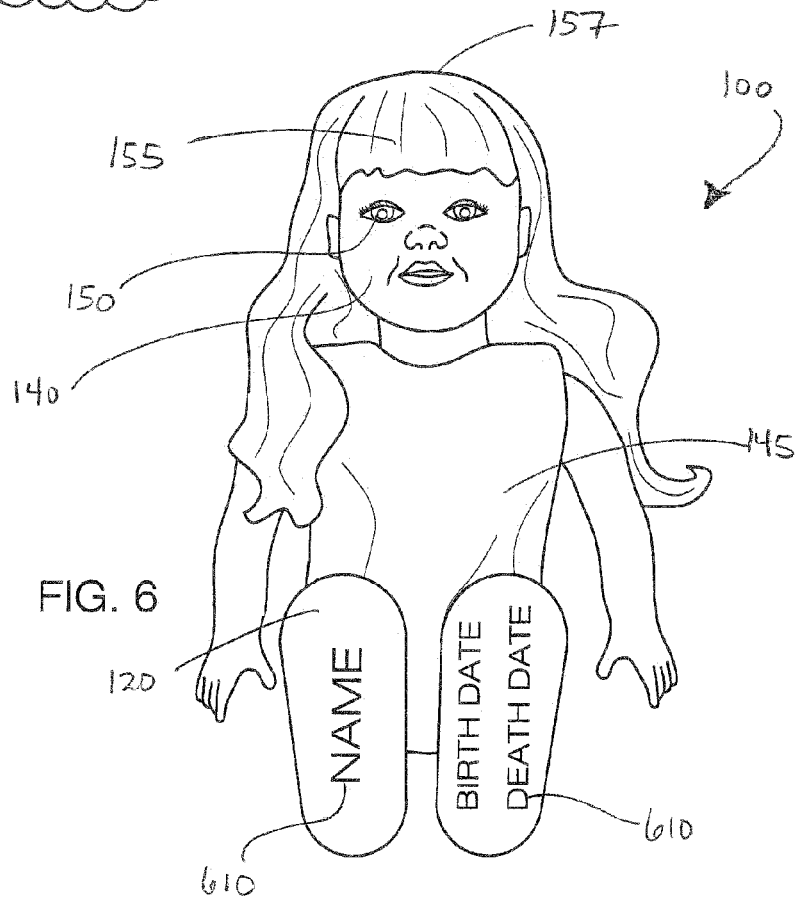
FIG. 6 is a front view of another embodiment of the doll urn the present invention

310 ashes
320 secure container for ashes
321 top surface of secure container
322 bottom surface of secure container
323 removable lid of secure container
350 screw
610 writing Referring now to FIG. 1-6, the present invention features a doll urn for storing a human's or a pet's ashes. The doll urn comprises a doll body having a neck, a torso, a right arm, a left arm, a right leg, a left leg, a right foot, a left foot, wherein writing is imprinted on the right foot, the left foot, or both feet. In some embodiments, shoes are disposed on the left foot and/or right foot of the doll body, and writing is imprinted on the right shoe, left shoe, or both shoes. A doll head is attached to the neck of the doll body, wherein the doll head has a top surface and an aperture disposed on the top surface. The aperture is an opening to a hollow internal compartment (e.g., a cylindrical internal compartment) disposed in the doll head, wherein the internal compartment has a top end, a bottom end, and a nut secured at the bottom end.

The doll urn of the present invention further comprises a doll top having a top surface and a bottom surface, wherein the doll top is removably attached to the top surface of the doll head via a stopper disposed on the bottom surface. The stopper is for inserting into the aperture to close the top end of the internal compartment so as to seal off the internal compartment. The doll urn further comprises a voice recorder disposed on the doll body for recording or playing a message via a speaker.

In some embodiments, the doll top may be removed from the doll head such that a secure container (e.g., cylindrical container) holding the ashes may be inserted into the internal compartment via the aperture disposed on the top surface of the doll head. In some embodiments, the secure container (e.g., cylindrical container) has an open top end for inserting ashes, a closed bottom end, a removable lid that seals off the open top end, and a screw disposed on the bottom end, wherein the screw disposed on the bottom end of the secure container may be screwed into the nut disposed at the bottom end of the internal compartment to immobilize the secure container of ashes in the internal compartment.

In some embodiments, writing is imprinted onto the foot (e.g., foot, paw) of the doll urn. In some embodiments, writing includes a name, a birth date, a death date, the like, or a combination thereof. In some embodiments, writing is imprinted on the left foot, the right foot, both feet, one or more paws, the like, or a combination thereof.

The doll urn may be constructed in a variety of shapes, sizes, colors, and/or designs to shape and look like the deceased. For example, in the doll urn is a female doll or a male doll. In some embodiments, the doll urn is a dog, a cat, a bird, or the like. In some embodiments, the doll urn features brown eyes, blue eyes, green eyes, or the like. In some embodiments, the doll urn features short hair, long hair, curly hair, straight hair, shoulder-length hair, brown hair, blonde hair, red hair, black hair, white hair, gray hair, the like, or a combination thereof. In some embodiments, the doll urn features dark skin, light skin, medium-toned skin, or the like. In some embodiments, the doll urn features a dress, a skirt, a shirt, a pair of pants, a pair of shorts, a hair ribbon, a headband, a bracelet, a necklace, a watch, the like, or a combination thereof.

The doll urn may be constructed from a variety of materials. For example, in some embodiments, the doll urn is constructed from a material comprising porcelain. In some embodiments, the doll urn is constructed from a material comprising a rigid plastic material.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A doll urn for storing a human's or a pet's ashes, said doll urn comprising:

(b) a doll body having a neck, a torso, a right arm, a left arm, a right leg, a left leg, a right foot, a left foot, wherein writing is imprinted on at least one said foot;

(a) a doll head attached to the neck of the doll body, said doll head having a top surface and an aperture disposed on the top surface, wherein the aperture is an opening to a hollow internal compartment disposed in the doll head, wherein the internal compartment has a top end, a bottom end, and a nut secured at the bottom end;

(c) a doll top having a top surface and a bottom surface, said doll top removably attached to the top surface of the doll head via a stopper disposed on the bottom surface, wherein the stopper is for inserting into the aperture to close the top end of the internal compartment so as to seal off the internal compartment; and (c) a voice recorder disposed on the doll body for recording or playing a message via a speaker;

wherein the doll top is removable from the doll head such that a secure cylindrical container holding the ashes is inserted into the internal compartment via the aperture disposed on the top surface of the doll head, said secure cylindrical container having an open top end for inserting the ashes, a closed bottom end, a removable lid that seals off the open top end, and a screw disposed on the closed bottom end wherein the screw disposed on the closed bottom end of the secure cylindrical container is screwed into the nut disposed at the bottom end of the internal compartment to immobilize the secure cylindrical container of ashes in the internal compartment.

2. The doll urn of claim 1, wherein writing includes a name, a birth date, a death date, or a combination thereof.

* * * * *